United States Patent [19]

Bein

[11] 4,204,816

[45] May 27, 1980

[54] DISCHARGE AND PRESSURE RELIEF PORTS FOR MECHANISMS WITH INVOLUTE SHAPED VANES

[75] Inventor: Thomas W. Bein, Annapolis, Md.

[73] Assignee: The United States of America as represented by the Secretary of the Navy, Washington, D.C.

[21] Appl. No.: 940,528

[22] Filed: Sep. 8, 1978

[51] Int. Cl.[2] ..... F04C 1/02; F04C 15/02

[52] U.S. Cl. ..... 418/15; 418/55; 418/189

[58] Field of Search ..... 418/1, 15, 55, 59, 77, 418/180, 183, 188, 189

[56] References Cited

U.S. PATENT DOCUMENTS

| | | | |
|---|---|---|---|
| 3,874,827 | 4/1975 | Young | 418/55 |
| 4,129,405 | 12/1978 | McCullough | 418/55 |

*Primary Examiner*—John J. Vrablik

*Attorney, Agent, or Firm*—R. S. Sciascia; Q. E. Hodges

[57] ABSTRACT

In a pump having scroll vane impellers, rapid-opening additional discharge ports are formed by slats in the scroll vanes overlapping slats in the opposing end plates, thereby allowing fluids to be pumped without over-pressurization.

8 Claims, 8 Drawing Figures

FIG. 3
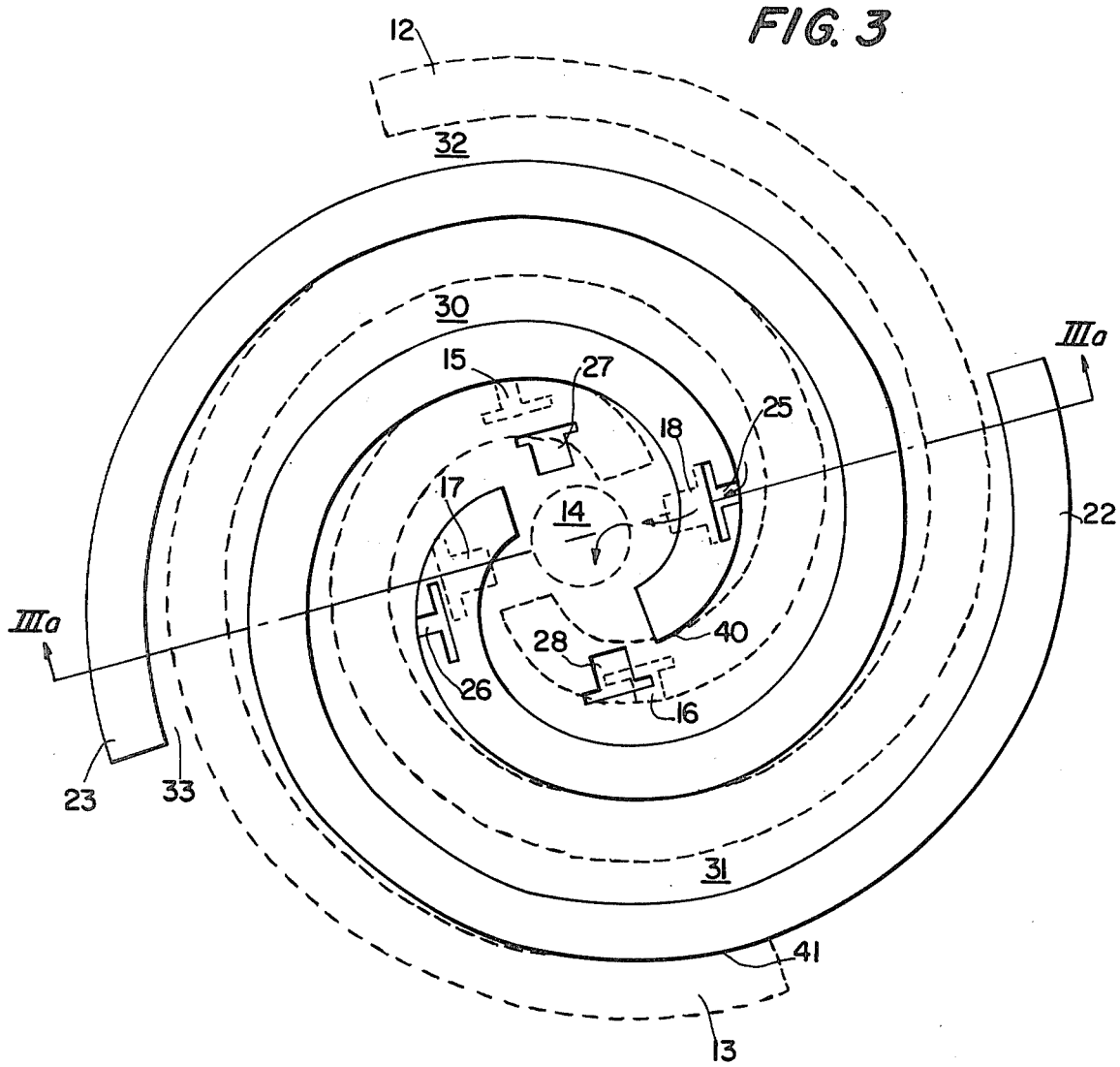
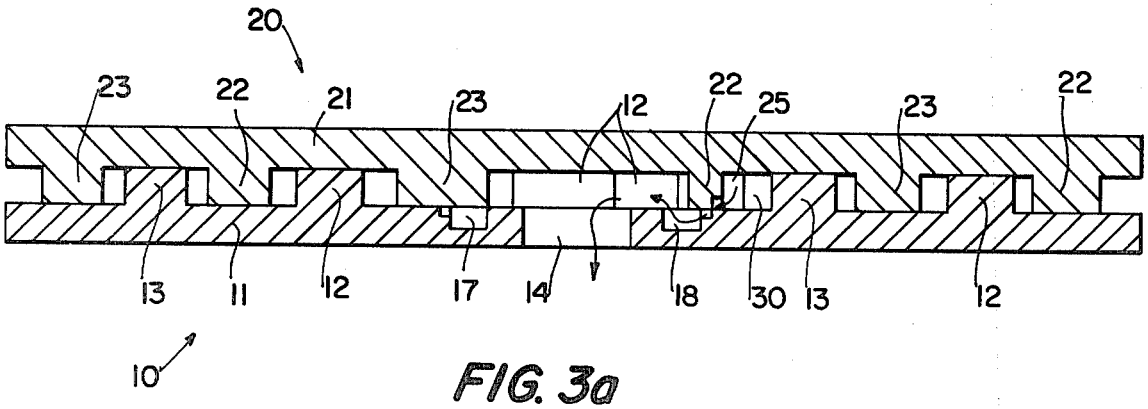
FIG. 3a

DISCHARGE AND PRESSURE RELIEF PORTS FOR MECHANISMS WITH INVOLUTE SHAPED VANES

The invention described herein may be manufactured and used by or for the Government of the United States of America for governmental purposes without the payment of any royalties thereon or therefor.

BACKGROUND OF THE INVENTION

This invention relates to positive displacement scroll pumps and in particular to additional discharge means affixed to the scroll impeller vanes and end plates.

A detailed description of scroll pump operation may be found in my copending U.S. application Ser. No. 891,963, filed Mar. 30, 1978. In general, however, scroll pumps operate with a relative orbiting motion between the meshed scroll vanes, forming crescent-shaped pockets between the vanes. The scroll vanes are not free to rotate relative to each other as one scroll member orbits about the other. In axial discharge pumps of the present type, the volume of the pocket continually decreases during the pumping cycle. This decreasing volume characteristic is useful in fluid compressors, in which the volume of the trapped pocket is reduced until the required discharge pressure is attained. Discharge is achieved by modifying one of the scroll vanes to allow the fluid to escape into the discharge area. In actual operation, the fluid in the trapped pocket continues to be compressed during the time that the discharge port is opening. This is a minor problem when the fluid is a gas, but when the fluid is a liquid the problems are significant. When pumping a liquid the nominal compression ratio has to be unity, but, due to the slowly opening discharge port and the continuing reduction in trapped pocket volume, severe overpressurization occurs. This results in ineffeciencies and probable mechanical damage to the pump due to the additional loading.

Prior art devices have attempted to overcome this problem by modifying the geometry of the scroll vanes to maintain a constant trapped pocket volume during the discharge period until the discharge port is fully opened. This method alleviates the overpressurization, but the required scroll vanes are difficult to fabricate.

SUMMARY OF THE INVENTION

Accordingly, the present invention overcomes many of the disadvantages of prior art scroll pumps by providing, in addition to the normal discharge port, an additional port that opens during the time period that the normal discharge port has not opened sufficiently to pass the fluid in the trapped pocket between the scroll vanes. At the time that the normal discharge port begins to slowly open, the additional discharge port opens rapidly and during the critical initial stage provides a discharge area many times greater than the area of the normal discharge port operating alone.

In one embodiment, the additional discharge port comprises two T-shaped rectangular slots, one located near the discharge end of a scroll vane and the other located on the corresponding end plate. As the discharge cycle begins, the slot in the scroll vane overlaps the slot in the opposite end plate and forms a port that allows the trapped fluid to discharge. Generally, the length of the rectangular slots determines the volume of fluid that will pass, while the width of the slots determines the length of time that the additional port will remain open.

OBJECTS OF THE INVENTION

It is therefore an object of the present invention to eliminate the overpressurization that occurs in prior art scroll machines used to pump noncompressible fluids.

Another object of the present invention is to provide additional discharge ports in the involute vanes of a scroll pump.

Still another object of the present invention is to provide additional discharge ports which are rapid-opening.

A further object of the present invention is to provide a liquid scroll pump that is easier to fabricate than prior art pumps.

BRIEF DESCRIPTION OF THE DRAWINGS

Other objects and many of the attendant advantages of the present invention will be readily apparent as the invention becomes better understood by reference to the following detailed description with the appended claims, when considered in conjunction with the accompanying drawings wherein:

FIGS. 3–6 are simplified cross-sectional views of the meshed scroll vanes which illustrate the pumping and discharge action of a scroll pump built in accordance with this invention, wherein the stationary scroll vanes are shown by dashed lines and the orbiting scroll vanes are shown by solid lines;

FIG. 3*a* is a cross-sectional view of the meshed scroll vanes shown in FIG. 3, as seen in the plane of line III*a*—III*a;*

FIG. 4 shows the orbiting scroll vanes displaced in a clockwise direction 90° from their positions shown in FIG. 3;

FIG. 5 shows the orbiting scroll vanes displaced 180° from their positions shown in FIG. 3;

FIG. 6 shows the orbiting scroll vanes displaced 270° from their positions shown in FIG. 3.

DESCRIPTION OF THE PREFERRED EMBODIMENT

Figure 2:
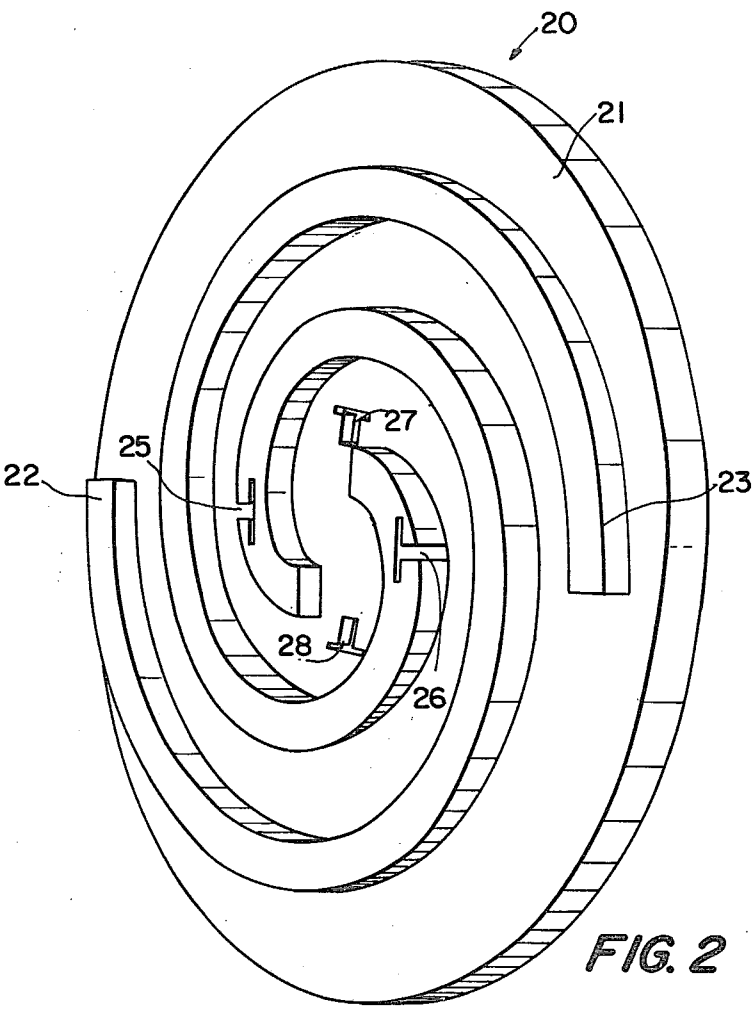
FIG. 2 is a pictorial view of the orbiting scroll member used in the preferred embodiment of this invention.
Figure 1:
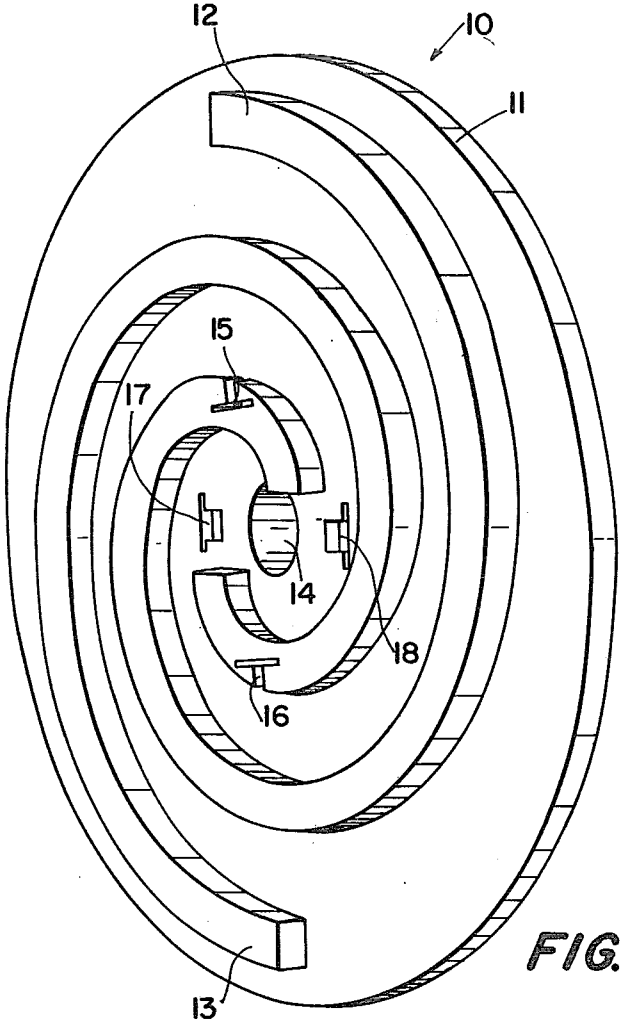
FIG. 1 is a pictorial view of the stationary scroll member used in the preferred embodiment of the present invention, illustrating the scroll vanes and discharge ports.

Referring now to the drawings, wherein like reference numerals designate the same or corresponding parts throughout the several views, there are shown in FIGS. 1 and 2, respectively, a stationary scroll member 10 and an orbiting scroll member 20. The stationary scroll member 10 is formed of a circular disc-shaped end plate 11 and two scroll vanes 12 and 13. It should be noted that the number of scroll vanes shown is illustrative only and the present invention is not intended to be limited to any particular number of vanes. Scroll vanes 12 and 13 are similar in size and shape, having involute or spiroidal contours, with vane 13 oriented 180° from vane 12 about an axis perpendicular to and passing through the center of end plate 11. A T-shaped slot 15 is formed into vane 12 at a point approximately 90° in angular displacement from the inner tip of the spiral. A similar slot 16 is formed at the corresponding location on vane 13. The bottom of the "T" of slots 15 and 16 faces away from the center of end plate 11 and extends the full height of the vanes 12, 13 above the end plate. Two additional T-shaped slots 17, 18 are formed into end plate 11 near the center of scroll member 10. End plate slots 17 and 18 are angularly displaced 90° from vane slots 15 and 16, and 180° from each other. The bottom of the "T" of slots 17 and 18 faces toward the center of end plate 11, with the depth of the slots being approximately one-half the thickness of end plate 11. A circular main discharge port 14 is located at the center of end plate 11.

The orbiting scroll member 20 is a "mirror image" of stationary scroll member 10, having scroll vanes 22 and 23 and slots 25, 26, 27, and 28 corresponding to scroll vanes 12, 13 and slots 15, 16, 17, and 18 on stationary member 10, except that scroll member 20 does not have a main discharge port.

Referring now to FIG. 3, when the scroll pump of the present invention is assembled, orbiting scroll member 20 (solid lines) is placed in contact with stationary scroll member 10 (dashed lines) in a manner such that vanes 12 and 13 are meshed with vanes 22 and 23. If the outer tip of vane 12 is used as the 0° reference point, then the outer tip of vane 22 will be angularly displaced therefrom 90° in a clockwise direction. Similarly, since the outer tip of vane 13 is displaced 180° from that of vane 12, the outer tip of vane 23 will be displaced 270° from the tip of vane 12, all in a clockwise direction. It is evident from FIG. 3 that, during the operating cycle of the scroll pump, slots 15 and 16 in vanes 12 and 13 of stationary member 10 will overlap and align with slots 27 and 28, respectively, in the end plate 21 of orbiting member 20. In a like manner, slots 25 and 26 in vanes 22 and 23 of orbiting member 20 will overlap and align with slots 18 and 17, respectively, in the end plate 11 of stationary member 10.

Figure 7:
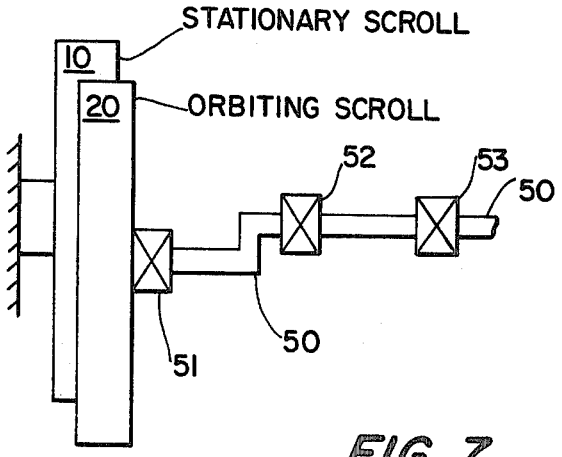
FIG. 7 is a simplified plan view illustrating one method of orbiting the orbiting member with respect to the stationary member in the present scroll pump.

The scroll members of the present invention may be driven, for example, by means such as an offset drive shaft, or by the synchronously rotating means described in my copending application referred to hereinabove. FIG. 7 shows one method of producing the necessary relative orbiting motion, wherein orbiting member 20 is mounted by way of bearing 51 on the offset end of a drive shaft 50, which in turn is supported by bearings 52 and 53. As drive shaft 50 is rotated, the center of member 20 orbits about the center of member 10 thus creating the pumping action described below.

Figure 4:
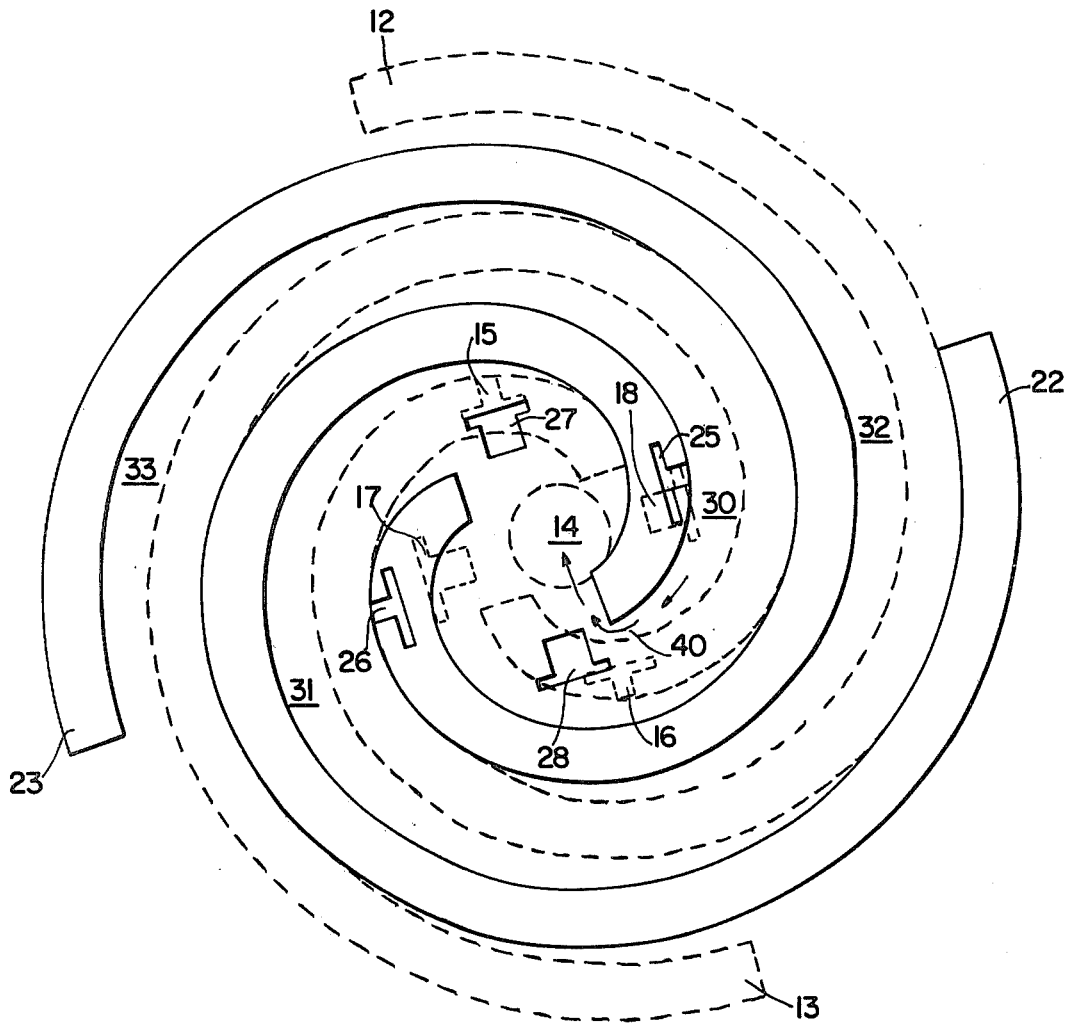
Figure 5:
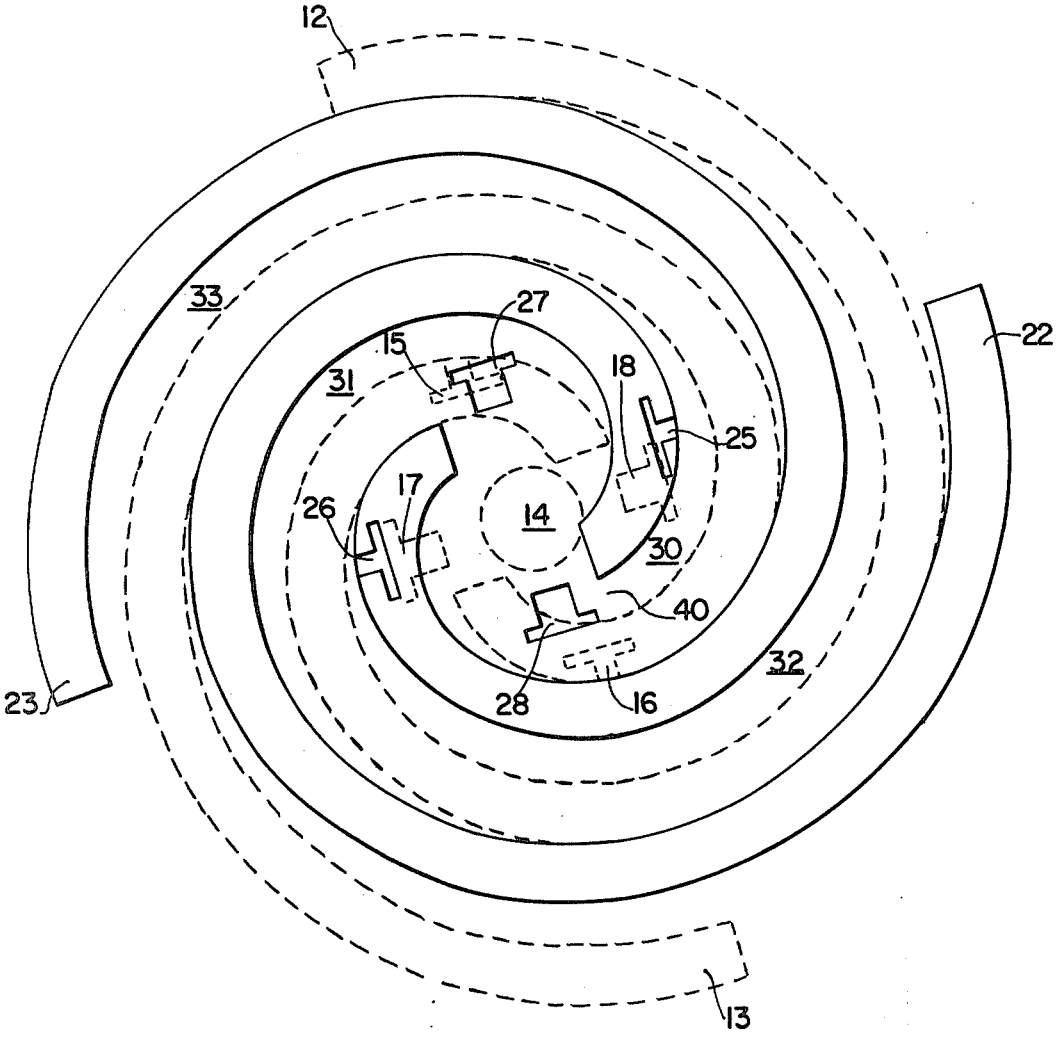
Figure 6:
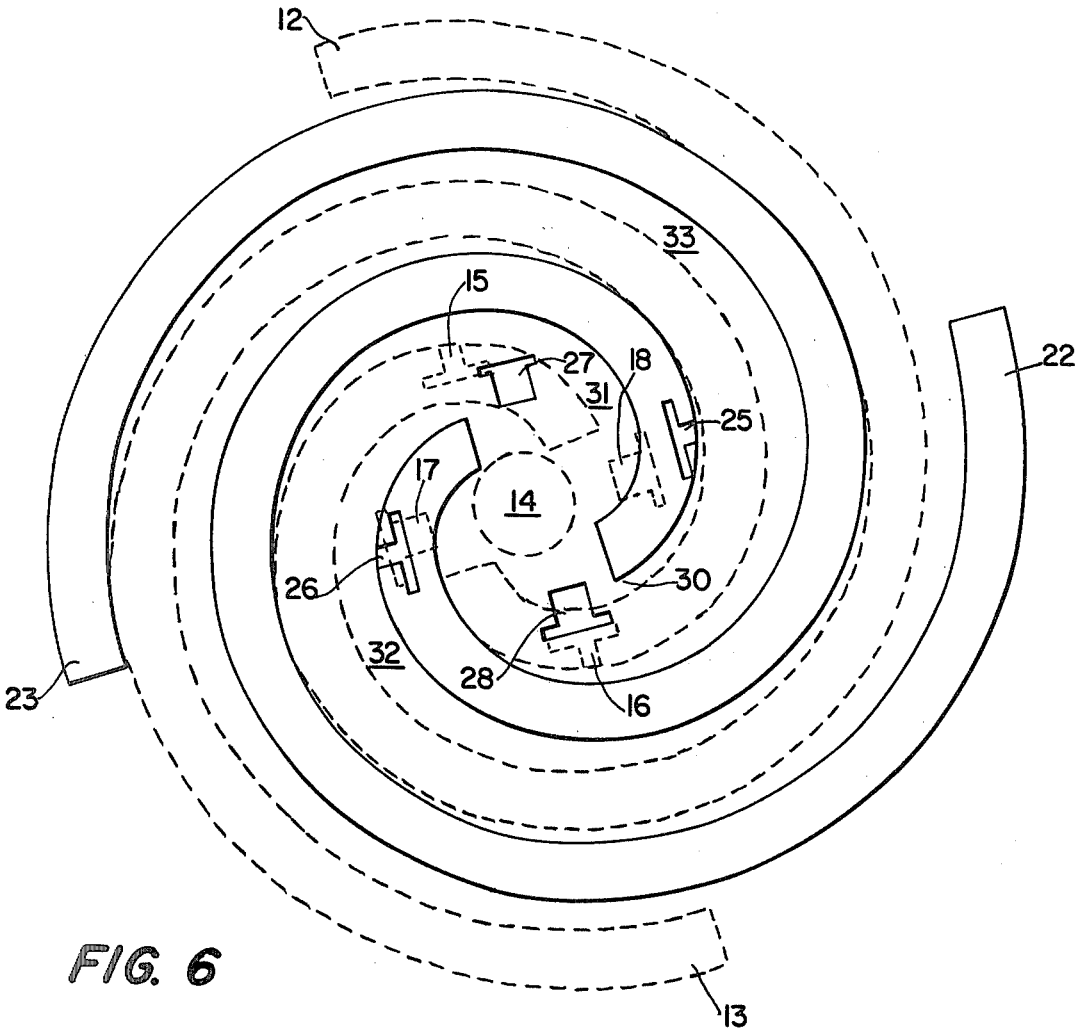

Referring to FIGS. 3–6, the operation of the present scroll pump will now be described in detail. As stated above, scroll pumps operate with a relative orbiting motion of the moving member with respect to the stationary member, forming crescent-shaped pockets between the respective scroll vanes. In the present pump, orbiting scroll vanes 22 and 23 (shown by solid lines in the drawings) move in a relative orbiting motion with respect to stationary scroll vanes 12 and 13 (shown by dashed lines in the drawings). As best shown in FIG. 3, the orbiting and stationary members are in a position such that a pocket 30 has just been formed between scroll vanes 13 and 22, bounded by contact point 40 at the inner tip of vane 22 and contact point 41 at the outer tip of vane 13. In prior art pumps, further movement of vane 22 would cause overpressurization of the fluid in pocket 30 before the port at contact point 40 could open sufficiently to discharge the trapped fluid. In the present pump, referring to FIG. 3*a*, just as pocket 30 is formed, slot 25 in vane 22 is starting to overlap slot 18 in end plate 11. The next incremental movement of vane 22 causes slots 18 and 25 to overlap and form a discharge channel under vane 22, thereby allowing the trapped fluid in pocket 30 to escape into the discharge area and out through main discharge port 14 as shown by the arrows in FIGS. 3 and 3*a*. Referring now to FIG. 4, orbiting vane 22 has orbited approximately 90° clockwise from its position shown in FIG. 3. The normal discharge port has now opened at point 40, allowing the fluid in pocket 30 to discharge to port 14, as shown by the arrows. The discharge channel under orbiting vane 22 is closed off, since vane 22 now covers the remainder of slot 18 in stationary end plate 11. In FIG. 5, vane 22 has orbited approximately 90° clockwise from its position shown in FIG. 4. The discharge area at point 40 is now fully open, while the volume of pocket 30 continues to decrease. Another 90° clockwise orbital movement places the orbiting vane 22 in the position shown in FIG. 6, in which it can be seen that the volume of pocket 30 has decreased even further, discharging almost all of the fluid that was trapped therein. After yet another 90° clockwise orbital movement scroll vane 22 will have orbited 360°, thereby completing one full pumping cycle, and the scroll vanes will again be in the position shown in FIG. 3.

Following the locations and the shapes of pockets 31, 32, and 33 through the same sequence of positions of orbiting vanes 22 and 23 shows how the pumping and discharge action occurs. It is readily apparent from FIGS. 3–6 that slots 15 and 27 together form a discharge channel, for pocket 31; slots 17 and 26 together form a discharge channel for pocket 32; and slots 16 and 28 together form a discharge channel for pocket 33. Thus, the discharge channels formed by respective overlapping vane and end plate slots form pressure relief means for venting the fluid in the respective trapped pocket to the main discharge port 14 to prevent overpressurization of the fluid contained therein.

Referring again to FIGS. 3–6, it can be seen that the additional discharge channels formed by the overlapping slots are rapid-opening as compared to the normal discharge ports (e.g., at point 40 in FIG. 4) formed by the separation of the scroll vanes. The term "rapid-opening" means that, for the same number of degrees that scroll member 20 orbits about scroll member 10, a discharge channel will present a much greater discharge area than will a normal discharge port. This allows the trapped fluid to discharge before any significant overpressurization can occur.

The dimensions of corresponding discharge slots (e.g., slots 18 and 25) are sized to pass the volume of fluid that cannot escape through the normal discharge port (e.g., at point 40). In the disclosed embodiment, the additional discharge slots comprise overlapping rectangular or T-shaped slots. The length of the rectangle, i.e., the long portion of the top of the "T", determines the volume of fluid that can pass, whereas the width of the rectangle, i.e., the narrow portion of the top of the "T", determines the length of time that the port will remain open. It is contemplated that ports having shapes other than those in the disclosed embodiment, for example, circular and U-shaped openings, may also be effectively used. Also, different paths may be used to vent the trapped volume, such as a path inside the scroll vane. It is further contemplated that, in pumps whose members orbit in the opposite direction from the members of the present pump, the discharge channels would be located at the outer portions of the scroll vanes and end plates.

Obviously, many modifications and variations of this invention are possible in the light of the above teachings. It is therefore to be understood that within the scope of the appended claims the invention may be practiced otherwise than as specifically described.

What is claimed is:

1. In a positive displacement fluid pump including oppositely disposed interfitting stationary and orbiting members having end plates with scroll vanes affixed thereto, wherein said stationary member includes a main discharge port for the pump and said orbiting member is driven to orbit with respect to said stationary member so that adjacent interfitting vanes of said opposing members make moving line contacts therebetween to close off and define a moving, fluid pocket of variable volume moving toward said main discharge port and having a normal discharge port defined by the discharge end portion of the respective orbiting and stationary vanes, the improvement comprising:

pressure relief means for discharging the fluid in said pocket to said main discharge port through a discharge channel as said pocket approaches closure to prevent overpressurization of the fluid in said closed pocket and for terminating the flow of fluid through said discharge channel as said discharge end portion of a selected orbiting vane moves toward said main discharge port and draws apart from the corresponding stationary vane to form said normal discharge port and to open the discharge portion of said pocket into fluid communication with said main discharge port.

2. The pump according to claim 1, wherein said pressure relief means includes:

a slot formed in each said orbiting vane; and radially extending slots formed in said stationary end plate, each of said stationary end plate slots being disposed in corresponding relationship with a respective one of said orbiting vane slots in the opposing member so that each of said orbiting vane slots will overlap a corresponding one of said stationary end plate slots to form said discharge channel as respective said pocket approaches closure.

3. The pump according to claim 1, wherein said pressure relief means includes:

slots formed in said stationary end plate; and a slot formed in each of said orbiting vanes in corresponding orbiting relationship with a respective one of said end plate slots;

respective ones of said slots in said end plate and said vane being positioned in overlapping alignment to form said discharge channel as said pocket approaches closure and are positioned in misalignment by movement of said orbiting vane to close said discharge channel as the normal discharge port of said pocket is formed.

4. A positive displacement fluid pump comprising:

a stationary member having an end plate and at least one involute scroll vane affixed thereto;

a main discharge port in said stationary member;

an orbiting member having an end plate and at least one involute scroll vane affixed thereto, said orbiting member being positioned in opposing relationship to said stationary member so that, during operation, said stationary and said orbiting vanes are meshed to form a crescent-shaped trapped fluid pocket for each pair of vanes;

driving means for orbiting said orbiting member with respect to said stationary member; and pressure relief means for venting the fluid in said trapped pocket to said main discharge port to prevent the overpressurization of fluid contained therein;

said pressure relief means including:

first slots formed in said stationary and said orbiting vanes near the discharge end thereof; and second slots formed in the end plates of said stationary and said orbiting members and positioned so that a respective one of said first slots in said scroll vanes will align with and overlap a corresponding second slot in the end plate of the opposing member as the corresponding trapped fluid pocket is formed;

said overlapped slots forming a channel to allow the fluid in said trapped pocket to discharge into said main discharge port, and as said discharge end of said orbiting vane draws apart from said stationary vane to form the normal discharge port of said trapped pocket, respective ones of said first and second slots are orbited relative to each other and become misaligned so that respective ones of said second slots on the opposing member are successively closed off to prevent fluid flow therethrough.

5. The system of claim 4 wherein said stationary and said orbiting members each include a plurality of involute scroll vanes.

6. The system of claim 4 wherein said first and said second slots are T-shaped.

7. The system of claims 4 or 6 wherein respective said first and said second slots are sized to vent the volume of fluid in said trapped pocket that cannot pass through said normal discharge port during the initial discharge stage of fluid from said trapped pocket.

8. The system of claim 6 wherein the top portion of each said T-shaped slot comprises a fluid control means for regulating the volume of fluid passing through the respective ones of said discharge channels, said control being proportional to the degree of overlap of said first and second slots and the period of time said first and second slots will be in an aligned position.

* * * * *